US008316821B2

(12) United States Patent
Lee et al.

(10) Patent No.: US 8,316,821 B2
(45) Date of Patent: Nov. 27, 2012

(54) METHOD AND SYSTEM FOR ENABLING CYLINDER BALANCING AT LOW IDLE SPEED USING CRANKSHAFT SPEED SENSOR

(75) Inventors: Byungho Lee, Ann Arbor, MI (US); B. Jerry Song, Novi, MI (US); Lee C. Walker, Swartz Creek, MI (US)

(73) Assignee: GM Global Technology Operations LLC

( * ) Notice: Subject to any disclaimer, the term of this patent is extended or adjusted under 35 U.S.C. 154(b) by 377 days.

(21) Appl. No.: 12/752,690

(22) Filed: Apr. 1, 2010

(65) Prior Publication Data

US 2011/0239984 A1 Oct. 6, 2011

(51) Int. Cl.
*F02D 41/08* (2006.01)

(52) U.S. Cl. ..... 123/339.14; 123/436

(58) Field of Classification Search ..... 123/339.1, 123/339.14, 436, 492, 493; 701/103–105, 701/110

See application file for complete search history.

(56) References Cited

U.S. PATENT DOCUMENTS

| | | | | |
|---|---|---|---|---|
| 5,445,128 | A * | 8/1995 | Letang et al. | 123/436 |
| 5,615,654 | A * | 4/1997 | Weisman et al. | 123/350 |
| 5,647,317 | A * | 7/1997 | Weisman et al. | 123/299 |
| 5,847,644 | A * | 12/1998 | Weisman et al. | 340/439 |
| 6,330,873 | B1 * | 12/2001 | Letang et al. | 123/322 |
| 7,950,368 | B2 * | 5/2011 | Pursifull et al. | 123/406.53 |
| 8,118,008 | B2 * | 2/2012 | Pursifull et al. | 123/339.11 |
| 2012/0145124 | A1 * | 6/2012 | Pursifull et al. | 123/406.5 |

OTHER PUBLICATIONS

U.S. Appl. No. 12/725,950, filed Mar. 17, 2010, Lee C. Walker.

* cited by examiner

*Primary Examiner* — Hai Huynh

(57) ABSTRACT

A method and control system for controlling the idle speed of an engine includes an engine speed module that generates an engine speed signal. The control system also includes an actuator control module that regulates an engine speed based on a desired idle speed when an engine idle mode is enabled and a balancing module that balances torque produced by cylinders of an engine based on the engine speed signal when the engine idle mode is enabled. The control module also includes an idle speed reduction module that determines an idle speed reduction based on the actual torques produced by the cylinders after the balancing module balances the torque and that decreases the desired idle speed based on the idle speed reduction.

20 Claims, 3 Drawing Sheets

METHOD AND SYSTEM FOR ENABLING CYLINDER BALANCING AT LOW IDLE SPEED USING CRANKSHAFT SPEED SENSOR

FIELD

The present disclosure relates to internal combustion engines and more particularly to engine control systems for balancing the engine cylinders during low engine idle speeds.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Air is drawn into an engine through an intake manifold. A throttle valve controls airflow into the engine. The air mixes with fuel provided by one or more fuel injectors to form an air/fuel mixture. The air/fuel mixture is combusted within one or more cylinders of the engine. In diesel engine systems, combustion is initiated by injection of the fuel into the cylinders. More specifically, heat provided by compression ignites injected fuel.

Combustion of the air/fuel mixture produces drive torque. More specifically, drive torque is generated through heat release and expansion that occurs during combustion of the air/fuel mixture within the cylinders. Torque is transferred by a crankshaft of the engine through a driveline (not shown) to one or more wheels to propel a vehicle. Exhaust gas is expelled from the cylinders to an exhaust system.

An engine control module (ECM) controls the torque output of the engine based on a desired torque. The desired torque may be based on driver inputs, such as accelerator pedal position, brake pedal position, cruise control inputs, and/or other suitable driver inputs. The desired torque may also be based on torque requested by other vehicle systems, such as a transmission control system, a hybrid control system, and/or a chassis control system. The ECM controls the torque output of the engine by controlling various engine operating parameters, such as airflow into the engine and fuel injection.

SUMMARY

The present disclosure uses a crankshaft sensor to determine when an imbalance is occurring in the engine at low idle speeds and adjusts the torque to reduce the imbalance.

In one aspect of the disclosure, a method of operating an engine includes generating an engine speed signal, regulating an engine speed based on a desired idle speed when an engine idle mode is enabled, balancing torque produced by cylinders of an engine based on the engine speed signal when the engine idle mode is enabled, determining an idle speed reduction based on the actual torques produced by the cylinders after balancing torque and decreasing the desired idle speed based on the idle speed reduction.

In another aspect of the disclosure, a control module for controlling the idle speed of an engine includes an engine speed module that generates an engine speed signal. The control system also includes an actuator control module that regulates an engine speed based on a desired idle speed when an engine idle mode is enabled and a balancing module that balances torque produced by cylinders of an engine based on the engine speed signal when the engine idle mode is enabled. The control module also includes an idle speed reduction module that determines an idle speed reduction based on the actual torques produced by the cylinders after the balancing module balances the torque and that decreases the desired idle speed based on the idle speed reduction.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
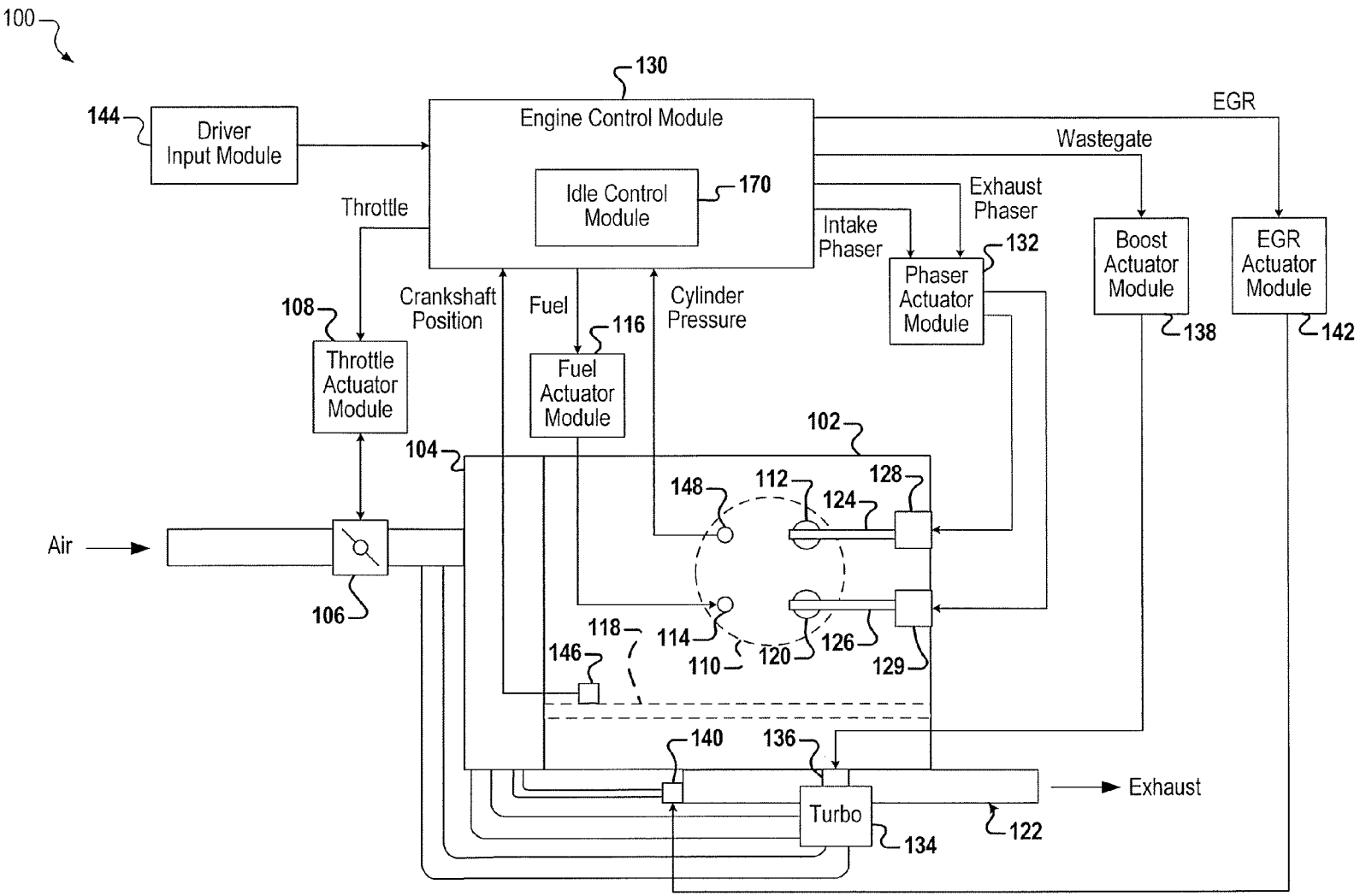
FIG. 1 is a functional block diagram of an exemplary diesel engine system according to the principles of the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

A diesel-type internal combustion engine combusts a mixture of air and diesel fuel to generate drive torque. While the engine is idling, an engine control module (ECM) controls torque output by the engine to maintain engine speed at approximately a desired idle speed. The desired idle speed may initially be set to a predetermined idle speed.

An ECM according to the present disclosure determines an actual torque produced by each cylinder of the engine and adjusts the amount of fuel supplied to each of the cylinders to balance torque production across the cylinders. After balancing the torque production, the ECM determines an actual torque produced by each cylinder and determines a standard deviation of the actual torques. The ECM determines an idle speed reduction based on the standard deviation and reduces the desired idle speed based on the idle speed reduction.

Referring now to FIG. 1, a functional block diagram of an exemplary diesel engine system 100 is presented. The diesel engine system 100 includes an engine 102 that combusts a mixture of air and diesel fuel to produce drive torque. One or more motor-generators (not shown) that selectively produce drive torque may also be implemented. Air is drawn into an intake manifold 104 through a throttle valve 106. A throttle actuator module 108 controls opening of the throttle valve 106 and, therefore, airflow into the engine 102. The throttle actuator module 108 may include, for example, an electronic throttle controller (ETC).

Air from the intake manifold 104 is drawn into cylinders of the engine 102. While the engine 102 includes multiple cylinders, for illustration purposes only, only a single representative cylinder 110 is shown. For example only, the engine 102 may include 2, 3, 4, 5, 6, 8, 10, and/or 12 cylinders. Air from the intake manifold 104 is drawn into the cylinder 110 through an associated intake valve 112. Lowering of a piston (not shown) within the cylinder 110 draws air into the cylinder 110.

After the piston reaches a bottom most position, referred to as bottom dead center (BDC), the piston rises and compresses the air within the cylinder 110. Compression of the air within the cylinder 110 generates heat. In some engine systems, fuel is injected into the cylinder 110 as air is drawn into the cylinder 110 and/or during compression.

An engine control module (ECM) 130 controls the amount (e.g., mass) of fuel injected by a fuel injector 114. More specifically, a fuel actuator module 116 controls opening of the fuel injector 114 based on signals from the ECM 130. For example only, the fuel actuator module 116 may control the period of time that the fuel injector 114 is maintained in a fully open position, which is referred to as an injection pulse width.

The fuel injector 114 may inject fuel directly into the cylinder 110 as shown in FIG. 1. In other implementations, the fuel injector 114 may inject fuel into the intake manifold 104 at a central location or may inject fuel into the intake manifold 104 at multiple locations, such as near the intake valve of each of the cylinders.

The ECM 130 also controls the timing of initiation of combustion. In the diesel engine system 100, the ECM 130 controls the timing of initiation of combustion by controlling when fuel is injected into the cylinder 110. The heat generated though compression initiates combustion when fuel is injected into the cylinder 110. The time when fuel is supplied to the cylinder 110 may be specified relative to, for example, the TDC position or the BDC position.

Combustion of the air/fuel mixture drives the piston down, and the piston rotatably drives a crankshaft 118. The piston drives the crankshaft 118 down until the piston reaches the BDC position. The piston then begins moving up again and expels the byproducts of combustion through an associated exhaust valve 120. The byproducts of combustion are exhausted from the vehicle via an exhaust system 122.

One engine cycle, from the standpoint of one of the cylinders, involves two revolutions of the crankshaft 118 (i.e., 720° of crankshaft rotation). One engine cycle for one cylinder can be described in terms of four phases: an intake phase; a compression phase; a combustion phase; and an exhaust phase. For example only, the piston lowers toward the BDC position and air is drawn into the cylinder 110 during the intake phase. The piston rises toward the TDC position and compresses the contents (e.g., air or an air and fuel) of the cylinder 110 during the compression phase. Fuel is supplied into the cylinder 110 and is combusted during the combustion phase, and the combustion drives the piston toward the BDC position. The piston rises toward the TDC to expel the resulting exhaust gas from the cylinder 110 during the exhaust phase.

The intake valve 112 is controlled by an intake camshaft 124, and the exhaust valve 120 is controlled by an exhaust camshaft 126. In other implementations, multiple intake camshafts may control multiple intake valves per cylinder and/or may control the intake valves of multiple banks of cylinders. Similarly, multiple exhaust camshafts may control multiple exhaust valves per cylinder and/or may control exhaust valves for multiple banks of cylinders.

An intake cam phaser 128 controls the intake camshaft 124 and, therefore, controls opening (e.g., lift, timing, and duration) of the intake valve 112. Similarly, an exhaust cam phaser 129 controls the exhaust camshaft 126 and, therefore, controls opening (e.g., lift, timing, and duration) of the exhaust valve 120. The timing of the opening of the intake 112 and exhaust valves 120 may be specified relative to, for example, the TDC position or the BDC position. A phaser actuator module 132 controls the intake cam phaser 128 and the exhaust cam phaser 129 based on signals from the ECM 130.

The diesel engine system 100 may also include a boost device that provides pressurized air to the intake manifold 104. For example only, the diesel engine system 100 includes a turbocharger 134. The turbocharger 134 is powered by exhaust gases flowing through the exhaust system 122 and provides a compressed air charge to the intake manifold 104. The turbocharger 134 may include a variable geometry turbo (VGT) or another suitable type of turbocharger. Other engine systems may also include more than one turbocharger or boost device.

A wastegate 136 selectively allows exhaust gas to bypass the turbocharger 134, thereby reducing the turbocharger's output (or boost). A boost actuator module 138 controls boost of the turbocharger 134 based on signals from the ECM 130. The boost actuator module 138 may modulate the boost of the turbocharger 134 by, for example, controlling the position of the wastegate 136 or the turbocharger 134 itself (e.g., vane position).

An intercooler (not shown) may be implemented to dissipate some of the compressed air charge's heat. This heat may be generated when the air is compressed. Another source of heat is the exhaust system 122. Other engine systems may include a supercharger that provides compressed air to the intake manifold 104 and is driven by the crankshaft 118.

The diesel engine system 100 may also include an exhaust gas recirculation (EGR) valve 140, which selectively redirects exhaust gas back to the intake manifold 104. While the EGR valve 140 is shown in FIG. 1 as being located upstream of the turbocharger 134, the EGR valve 140 may be located downstream of the turbocharger 134. An EGR cooler (not shown) may also be implemented to cool redirected exhaust gas before the exhaust gas is provided to the intake manifold 104. An EGR actuator module 142 controls opening of the EGR valve 140 based on signals from the ECM 130. The EGR opening may be varied to adjust one or more combustion parameters and/or adjust the boost of the turbocharger 134.

The ECM 130 regulates the torque output of the engine 102 based on driver inputs and other inputs. The driver inputs may include, for example, accelerator pedal position, brake pedal position, cruise control inputs, and/or other suitable driver inputs. A driver input module 144 provides the driver inputs to the ECM 130. The other inputs may include, for example, inputs from various sensors and/or inputs from other vehicle control modules (not shown), such as a transmission control module, a hybrid control module, and a chassis control module.

The ECM 130 receives a crankshaft position signal from a crankshaft sensor 146. The crankshaft sensor 146 measures the position of the crankshaft 118 and outputs the crankshaft position signal accordingly. For example only, the crankshaft sensor 146 may include a variable reluctance (VR) sensor or another suitable type of crankshaft sensor.

The crankshaft position signal may include a pulse train. Each pulse of the pulse train may be generated as a tooth of an N-toothed wheel (not shown) that rotates with the crankshaft 118, passes the VR sensor. Accordingly, each pulse corresponds to an angular rotation of the crankshaft 118 by an amount equal to 360° divided by N teeth. The N-toothed wheel may also include a gap of one or more missing teeth, and the gap may be used as an indicator of one complete rotation of the crankshaft 118.

The diesel engine system 100 includes an idle control module 170 according to the principles of the present disclosure. While the idle control module 170 is shown as being located within the ECM 130, the idle control module 170 may be located in another suitable location, such as external to the ECM 130.

When the ECM 130 is in an idle mode, the idle control module 170 regulates the engine torque output to maintain the engine speed at a desired idle speed. For example only, the desired idle speed may initially be set to a predetermined idle speed (e.g., 700-1200 rpm). The idle control module 170 supplies desired amounts of fuel to the cylinders of the engine 102 to achieve the desired idle speed and determines the actual torque produced by each cylinder.

The idle control module 170 determines the actual torque produced by each cylinder based on the crankshaft signal. More specifically, the frequency contents within the crankshaft signal may be used. The crankshaft position/speed signal from a crankshaft sensor may be used.

The idle control module 170 performs an imbalance analysis of the actual torques and determines a fuel balance factor for each cylinder based on each of the cylinders' respective torque imbalance (i.e., deviation from a mean torque). The respective fuel balance factors are applied to adjust the amount of fuel supplied to the cylinders during later occurring combustion events. The fuel balance factors balance the actual torques produced by the cylinders and minimize observable vibration.

Once the torque is balanced across the cylinders (i.e., after the fuel balance factors are applied), the idle control module 170 monitors the actual torque of each of the cylinders and performs a statistical analysis based on the actual torques. For example only, the idle control module 170 may determine the standard deviation of the actual torques from a mean torque. The idle control module 170 determines an idle speed reduction based on the result of the statistical analysis (e.g., the standard deviation). The idle control module 170 then reduces the desired idle speed by the amount of the idle speed reduction.

Figure 2:
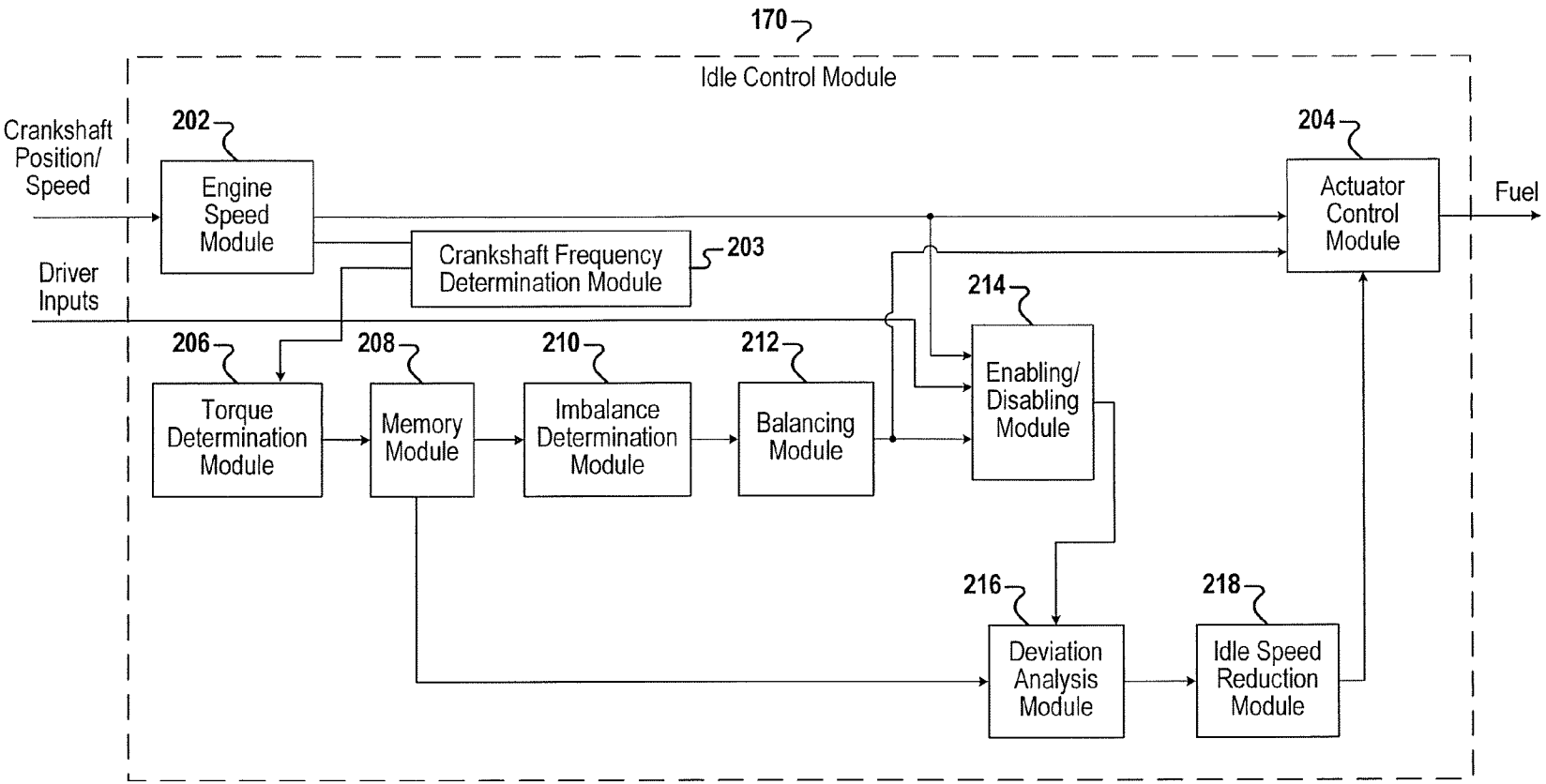
FIG. 2 is a functional block diagram of an exemplary idle control module according to the principles of the present disclosure.

Referring now to FIG. 2, a functional block diagram of an exemplary implementation of the idle control module 170 is presented. The idle control module 170 includes an engine speed module 202, a crankshaft frequency determination module 203, an actuator control module 204, a torque determination module 206, and a memory module 208. The idle control module 170 also includes an imbalance determination module 210 and a balancing module 212. The idle control module 170 also includes an enabling/disabling module 214, a deviation analysis module 216, and an idle speed reduction module 218.

The engine speed module 202 determines the rotational speed of the engine 102 (i.e., the engine speed) in revolutions per minute (rpm). In one implementation, the engine speed module 202 determines the engine speed based on the crankshaft signal provided by the crankshaft sensor 146 and/or another suitable measure of the engine speed. For example only, the engine speed module 202 may determine the engine speed based on the period of time between the pulses of the pulse train output by the crankshaft sensor 146.

The crankshaft frequency determination module 203 receives the engine speed module signal. The crankshaft frequency determination module 203 may determine frequency components of the crankshaft speed sensor. The frequencies may be determined using Fast Fourier Transforms (FFT) or other spectrum analysis. By analyzing the spectrum of the crankshaft speed sensor, the torque determination module 206 may determine the torque of the individual cylinders of the engine.

The actuator control module 204 controls engine actuators (and therefore torque production) to maintain the engine speed at approximately the desired idle speed when the ECM 130 is in an idle mode. The ECM 130 may be in the idle mode when, for example, the accelerator pedal is in a predetermined steady state position where the accelerator pedal rests when not being actuated by a driver.

The actuator control module 204 may determine a desired torque to maintain the engine speed at approximately the desired idle speed when the ECM 130 is in the idle mode. The actuator control module 204 determines a desired fuel amount for each of the cylinders of the engine 102 based on the desired torque and provides desired amount of fuel to the cylinders of the engine 102. The desired amounts of fuel may vary from cylinder to cylinder.

The torque determination module 206 determines the actual torque produced via combustion of the fuel supplied to the cylinder 110 based on the frequency contents in the crankshaft signal. The torque determination module 206 determines the actual torque produced for each of the cylinders of the engine based on frequency contents within the crankshaft signal. The frequencies may be analyzed so that each cylinder is analyzed individually. The firing of each cylinder is known from the timing of the crankshaft signal. The torque determination module 206 stores the actual torques produced by each of the cylinders in, for example, the memory module 208.

The imbalance determination module 210 accesses the stored actual torques and performs an imbalance analysis based on the actual torques. The imbalance determination module 210 may perform the imbalance analysis after each of the cylinders has completed one or more engine cycles. The imbalance determination module 210 determines a mean torque based on an average of the actual torques.

The imbalance determination module 210 determines a torque imbalance value for each of the cylinders based on a difference between the mean torque and the respective actual torques. For example only, the imbalance determination module 210 determines the torque imbalance value for the cylinder 110 based on the difference between the mean torque and the actual torque produced by the cylinder 110.

The balancing module 212 determines a fuel balancing factor for each of the cylinders based on the respective torque imbalance values. For example only, the balancing module 212 determines a fuel balance factor for the cylinder 110 based on the torque imbalance value determined for the cylinder 110. The fuel balance factors correspond to adjustments to the amount of fuel supplied to the respective cylinders that is necessary to adjust the actual torque output of the respective cylinders to approximately the mean torque.

The actuator control module 204 receives the fuel balancing factors and adjusts the amount of fuel supplied to the cylinders during later combustion events based on the respective fuel balance factors. In other words, the actuator control module 204 adjusts the amount of fuel supplied to the cylinders during later engine cycles based on the respective fuel balance factors. In this manner, the idle control module 170 balances the actual torques produced by the cylinders to minimize observable vibration during while the engine 102 is idling.

The enabling/disabling module 214 selectively enables and disables the deviation analysis module 216 based on whether fuel balancing has been applied while the ECM 130 is in the idle mode. For example only, the enabling/disabling module 214 may enable the deviation analysis module 216 when fuel balancing has been applied and the ECM 130 is in the idle mode. Written another way, the enabling/disabling module 214 may disable the deviation analysis module 216 when fuel balancing has not been applied or when the ECM 130 is not in the idle mode.

The enabling/disabling module 214 may determine that the ECM 130 is in the idle mode when, for example, the accelerator pedal is in the predetermined steady state position and the engine speed is approximately equal to the predetermined idle speed. The enabling/disabling module 214 may determine that fuel balancing has been applied, for example, when the fuel balancing factors have been provided to the actuator control module 204 and/or when one or more of the fuel balancing factors are different than predetermined initial balancing factors.

The torque determination module 206 continues determining and storing the actual torques produced by each of the cylinders after fuel balancing is applied. The deviation analysis module 216 accesses the actual torques determined after the fuel balancing and performs a statistical analysis based on the actual torques. The deviation analysis module 216 may perform the statistical analysis once each of the cylinders has completed one or more engine cycles.

For example only, the statistical analysis performed by the deviation analysis module 216 may include a standard deviation analysis. In other words, the deviation analysis module 216 may determine the standard deviation of the actual torques from a mean torque. The deviation analysis module 216 determines the mean torque based on an average of the actual torques determined after the fuel balancing.

The idle speed reduction module 218 determines an idle speed reduction value based on the standard deviation of the actual torques. For example only, the idle speed reduction module 218 may determine the idle speed reduction value based on a mapping of idle speed reductions indexed by standard deviation. The idle speed reduction value may correspond to a speed by which the desired idle speed could be reduced while maintaining tolerable vibration levels. For example only, the idle speed reduction values may increase as the standard deviation approaches zero. In another implementation, the idle speed reduction module 218 may determine a reduced desired idle speed based on the standard deviation and update the desired idle speed to the reduced desired idle speed. At standard deviations greater than a predetermined value (e.g., 0.10-0.15 or 10-15%), the idle speed reduction module 218 may increase the desired idle speed. The idle speed reduction module 218 may limit the idle speed reduction or idle speed increase values to prevent, for example, engine stalling or excessive noise.

The idle speed reduction module 218 provides the idle speed reduction value to the actuator control module 204. The actuator control module 204 reduces the desired idle speed based on the idle speed reduction value. For example only, the idle speed reduction module 218 may decrease the desired idle speed by the idle speed reduction value. The actuator control module 204 then controls the engine actuators (e.g., the amount of fuel supplied) based on the reduced, desired idle speed.

Figure 3:
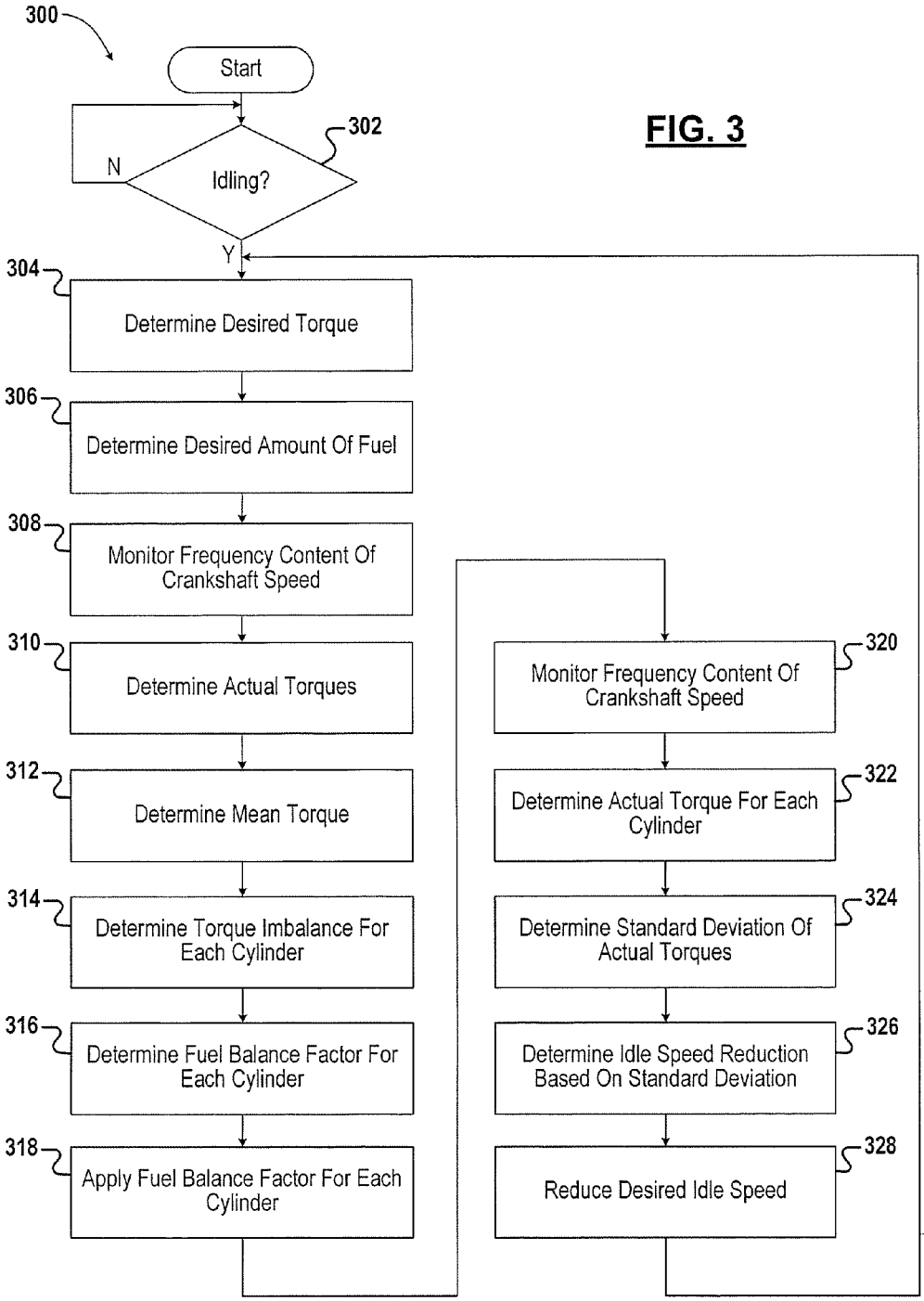
FIG. 3 is a flowchart depicting an exemplary method according to the principles of the present disclosure.

Referring now to FIG. 3, a flowchart depicting an exemplary method 300 is presented. In step 302 whether the engine 102 is idling is determined. If the engine is idling, step 304 is executed. If the engine is not idling step 302 is again executed. In step 304 the desired torque is determined. The desired torque corresponds to an amount of torque to be produced that is necessary to maintain the engine speed at the desired idle speed. The desired idle speed may be initially set to the predetermined idle speed.

In step 306, the desired amount of fuel to be supplied is determined. A desired amount of fuel for each of the cylinders of the engine 102 is determined in step 306. The desired amount(s) of fuel based on the desired torque is determined. The frequency contents of the crankshaft speed signal are determined in step 308.

The actual torque produced by each of the cylinders is determined in step 310. The actual torque produced by each of the cylinders is determined based on the frequency contents in the crankshaft signal during the combustion events of the respective cylinders. In step 312, the mean torque is determined. The mean torque is based on the average of the actual torques.

The torque imbalance value for each of the cylinders is determined in step 314. For example only, the torque imbalance value for one of the cylinders based on the difference between the mean torque and the actual torque produced by that cylinder may be used. The fuel balance factor for each of the cylinders is determined in step 316. The fuel balance factor for one of the cylinders based on the torque imbalance value of that cylinder may be generated.

In step 318, the fuel balance factors are applied. More specifically, adjustments to the amounts of fuel supplied to each of the cylinders during later combustion events (i.e., engine cycles) based on the respective fuel balance factors may be performed. In step 320 the frequency contents of the crankshaft signals associated with each of the cylinders are monitored.

The actual torque produced by each of the cylinders is determined in step 322. The actual torque produced by each of the cylinders may be monitored based on the frequency contents within the crankshaft signal during the combustion events of the respective cylinders. In step 324 the standard deviation of the actual torques is determined.

In step 326, the idle speed reduction value based on the standard deviation is determined. In another implementation, the method may determine a reduced desired idle speed in step 326. In step 328 the desired idle speed may be reduced based on the idle speed reduction value. In implementations where the reduced desired idle speed is determined, the desired idle speed may be updated to the reduced desired idle speed. After step 328, step 304 is performed.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. An idle control system for a vehicle comprising:

an engine speed module that generates an engine speed signal;

an actuator control module that regulates an engine speed based on a desired idle speed when an engine idle mode is enabled;

a balancing module that balances torque produced by cylinders of an engine based on the engine speed signal when the engine idle mode is enabled; and an idle speed reduction module that determines an idle speed reduction based on actual torques produced by the cylinders after the balancing module balances the torque and that decreases the desired idle speed based on the idle speed reduction.

2. The idle control system of claim 1 wherein the idle speed reduction module determines a second desired idle speed based on a standard deviation and updates the desired idle speed to the second desired idle speed, and wherein the second desired idle speed is less than the desired idle speed.

3. The idle control system of claim 1 wherein the idle speed reduction module subtracts the idle speed reduction from the desired idle speed.

4. The idle control system of claim 1 wherein the balancing module determines fuel balancing factors based on torque imbalances of each of the cylinders, respectively, and adjusts an amount of fuel supplied to each of the cylinders based on the respective fuel balancing factors.

5. The idle control system of claim 4 further comprising an imbalance analysis module that determines the torque imbalances based on a difference between pre-balancing actual torques produced by each of the cylinders before the balancing module balances the torque, respectively, and a mean of the pre-balancing actual torques.

6. The idle control system of claim 5 further comprising a torque determination module that determines the pre-balancing actual torques based on frequency contents of the engine speed signal.

7. The idle control system of claim 5 further comprising an enabling/disabling module that disables the imbalance analysis module when the engine idling mode is disabled.

8. The idle control system of claim 1 further comprising a torque determination module that determines the actual torques based on frequency contents of the engine speed signal.

9. The idle control system of claim 1 wherein the actuator control module adjusts at least one engine operating parameter based on the desired idle speed.

10. The idle control system of claim 1 wherein the actuator control module reduces an amount of diesel fuel supplied to the cylinders after the desired idle speed is decreased by the idle speed reduction.

11. A method of operating a vehicle comprising:

generating an engine speed signal;

regulating an engine speed based on a desired idle speed when an engine idle mode is enabled;

balancing torque produced by cylinders of an engine based on the engine speed signal when the engine idle mode is enabled;

determining an idle speed reduction based on actual torques produced by the cylinders after balancing torque; and decreasing the desired idle speed based on the idle speed reduction.

12. The method of claim 11 further comprising determining a second desired idle speed based on a standard deviation and updating the desired idle speed to the second desired idle speed, and wherein the second desired idle speed is less than the desired idle speed.

13. The method of claim 11 further comprising subtracting the idle speed reduction from the desired idle speed.

14. The method of claim 11 further comprising determining fuel balancing factors based on torque imbalances of each of the cylinders, respectively, and adjusting an amount of fuel supplied to each of the cylinders based on the respective fuel balancing factors.

15. The method of claim 14 further comprising determining the torque imbalances based on a difference between pre-balancing actual torques produced by each of the cylinders before the balancing module balances the torque, respectively, and a mean of the pre-balancing average torques.

16. The method of claim 15 further comprising determining the pre-balancing actual torques based on frequency contents of the engine speed signal.

17. The method of claim 15 further comprising disabling the determining the torque imbalances when the engine idling mode is disabled.

18. The method of claim 11 further comprising determining the actual torques based on frequency contents of the engine speed signal.

19. The method of claim 11 further comprising adjusting at least one engine operating parameter based on the desired idle speed.

20. The method of claim 11 further comprising reducing an amount of diesel fuel supplied to the cylinders after the desired idle speed is decreased by reducing the idle speed.

* * * * *